United States Patent [19]

Shanton

[11] Patent Number: 4,509,065

[45] Date of Patent: Apr. 2, 1985

[54] RECORD MATERIAL

[75] Inventor: Kenneth J. Shanton, Beaconsfield, England

[73] Assignee: The Wiggins Teape Group Limited, Hampshire, England

[21] Appl. No.: 442,565

[22] Filed: Nov. 18, 1982

[30] Foreign Application Priority Data

| | | | |
|---|---|---|---|
| Dec. 4, 1981 | [GB] | United Kingdom | 8136583 |
| Dec. 4, 1981 | [GB] | United Kingdom | 8136584 |
| Dec. 9, 1981 | [GB] | United Kingdom | 8137069 |
| Dec. 9, 1981 | [GB] | United Kingdom | 8137070 |
| Dec. 9, 1981 | [GB] | United Kingdom | 8137071 |
| Dec. 9, 1981 | [GB] | United Kingdom | 8137073 |

[51] Int. Cl.[3] ..... B41M 5/16; B41M 5/18; B41M 5/22

[52] U.S. Cl. ..... 346/225; 346/210; 346/211; 346/212; 346/219; 346/226

[58] Field of Search ..... 282/27.5; 427/150–153; 428/328, 330, 331, 320.4–320.8, 411, 488, 537, 913, 914; 346/210–212, 219, 225, 226

[56] References Cited

U.S. PATENT DOCUMENTS

| | | | |
|---|---|---|---|
| 2,505,471 | 4/1950 | Green | 346/225 |
| 2,505,475 | 4/1950 | Green | 346/225 |
| 2,505,476 | 4/1950 | Green | 346/225 |
| 2,505,477 | 4/1950 | Green | 346/225 |
| 2,505,479 | 4/1950 | Green | 346/225 |
| 2,505,480 | 4/1950 | Green | 346/225 |
| 2,505,483 | 4/1950 | Green | 346/225 |
| 2,505,484 | 4/1950 | Green | 346/225 |
| 2,505,485 | 4/1950 | Green | 346/225 |
| 2,505,486 | 4/1950 | Green | 346/225 |
| 2,505,489 | 4/1950 | Green | 346/225 |
| 2,618,573 | 11/1952 | Green | 346/225 |
| 2,702,765 | 2/1955 | Steinhardt | 346/225 |
| 2,757,085 | 7/1956 | Pacquin | 346/225 |
| 3,223,546 | 12/1965 | Hemstock | 346/225 |
| 3,330,722 | 7/1967 | Amano et al. | 346/225 |
| 3,565,653 | 2/1971 | Hemstock et al. | 346/225 |
| 3,736,285 | 5/1973 | Miller | 346/225 |
| 3,980,492 | 9/1976 | Thompson | 346/225 |
| 4,022,735 | 5/1977 | Thompson | 346/225 |
| 4,038,097 | 7/1977 | Traxler et al. | 346/225 |
| 4,109,048 | 8/1978 | Dessauer et al. | 346/225 |
| 4,218,504 | 8/1980 | Yamato et al. | 346/225 |

FOREIGN PATENT DOCUMENTS

| | | | |
|---|---|---|---|
| 871604 | 3/1953 | Fed. Rep. of Germany | 346/225 |
| 878806 | 6/1953 | Fed. Rep. of Germany | 346/225 |
| 1152429 | 2/1964 | Fed. Rep. of Germany | 346/225 |
| 2364255 | 7/1975 | Fed. Rep. of Germany | 346/225 |
| 3034486 | 2/1981 | Fed. Rep. of Germany | 346/225 |
| 38-22819 | 10/1963 | Japan | 346/225 |
| 44-2193 | 1/1969 | Japan | 346/225 |
| 52-32716 | 3/1977 | Japan | 346/225 |
| 628960 | 9/1949 | United Kingdom | 346/225 |
| 629165 | 9/1949 | United Kingdom | 346/225 |
| 666437 | 2/1952 | United Kingdom | 346/225 |
| 710597 | 6/1954 | United Kingdom | 346/225 |
| 1271304 | 4/1972 | United Kingdom | 346/225 |
| 1307319 | 2/1973 | United Kingdom | 346/225 |
| 1392946 | 5/1975 | United Kingdom | 346/225 |
| 1445866 | 8/1976 | United Kingdom | 346/225 |
| 1451982 | 10/1976 | United Kingdom | 346/225 |
| 1467003 | 3/1977 | United Kingdom | 346/225 |
| 1497663 | 1/1978 | United Kingdom | 346/225 |

*Primary Examiner*—Bruce H. Hess

*Attorney, Agent, or Firm*—Burns, Doane, Swecker & Mathis

[57] ABSTRACT

A color developer for use in a pressure- or heat-sensitive record material comprises a particulate composite having as components hydrated zirconia and at least one of hydrated silica and hydrated alumina.

4 Claims, No Drawings

RECORD MATERIAL

This invention relates to record material, and a colour developer for use therein, and to a process for the production of the record material and the colour developer. The record material may be, for example, part of a pressure-sensitive copying system or of a heat-sensitive recording system.

In one known type of pressure-sensitive copying system, usually known as a transfer system, an upper sheet is coated on its lower surface with microcapsules containing a solution of one or more colourless colour formers and a lower sheet is coated on its upper surface with a colour developing co-reactant material. A number of intermediate sheets may also be provided, each of which is coated on its lower surface with microcapsules and on its upper surface with colour developing material. Pressure exerted on the sheets by writing or typing ruptures the microcapsules, thereby releasing the colour former solution on to the colour developing material on the next lower sheet and giving rise to a chemical reaction which develops the colour of the colour former. In a variant of this system, the microcapsules are replaced by a coating in which the colour former solution is present as globules in a continuous matrix of solid material.

In another type of pressure-sensitive copying system, usually known as a self-contained or autogeneous system, microcapsules and colour developing co-reactant material are coated onto the same surface of a sheet, and writing or typing on a sheet placed above the thus-coated sheet causes the microcapsules to rupture and release the colour former, which then reacts with the colour developing material on the sheet to produce a colour.

Heat-sensitive recording systems frequently utilise the same type of reactants as those described above to produce a coloured mark, but rely on heat to convert one or both reactants from a solid state in which no reaction occurs to a liquid state which facilitates the colour-forming reaction, for example by dissolution in a binder which is melted by the heat applied.

The sheet material used in such systems is usually of paper, although in principle there is no limitation on the type of sheet which may be used. When paper is used, the colour developing co-reactant material and/or the microcapsules may be present as a loading within the sheet material instead of as a coating on the sheet material. Such a loading is conveniently introduced into the papermaking stock from which the sheet material is made.

Zirconia, i.e. zirconium dioxide, $ZrO_2$, has long been recognised as a material suitable as a co-reactant for developing the colour of colour formers for use in record material, see for example U.S. Pat. Nos. 2505470 and 2777780. However, whilst it is quite effective when in powder form for developing the colour of a solution of a colour former such as crystal violet lactone, it is much less effective when coated on to paper as the active component of a colour developer composition, probably because its reactivity is suppressed by the presence of conventional paper coating binders, for example latex binders. A further problem is that the colour developed initially is very prone to fading.

It has now been found that a composite of hydrated zirconia in major to minor proportion with hydrated silica and/or hydrated alumina will develop a colour which is of good intensity and has good resistance to fading, particularly when modified by the presence of suitable metal compounds or ions. It should be noted that hydrated zirconia differs from zirconia as referred to above, which is presumed not to be hydrated.

Hydrated silica, various forms of alumina (at least some of which are hydrated) and hydrated silica/hydrated alumina composites have each in themselves been proposed as colour developing materials, see for example U.S. Pat. No. 2828341 in the case of silica, UK Patents Nos. 629165 and 1571325 in the case of alumina, UK Patent No. 1467003 in the case of a hydrated silica/-hydrated alumina composite, and UK Patent No. 1271304 in the case of all three of these, the composite in this instance being an aluminate salt precipitated on to hydrated silica. So far as is known however, it had not at the priority date hereof been proposed to utilise a composite of hydrated zirconia with hydrated silica and/or hydrated alumina as a colour developing material.

According to a first aspect of the invention, there is provided record material carrying a colour developer composition which comprises a particulate composite having as components hydrated zirconia and at least one of hydrated silica and hydrated alumina.

According to a second aspect of the invention, there is provided a colour developer for record material, comprising a particulate composite having as components hydrated zirconia and at least one of hydrated silica and hydrated alumina.

According to a third aspect of the invention, there is provided a process for the production of a colour developer for record material, comprising the step of synthesizing in an aqueous medium a particulate composite having as components hydrated zirconia and at least one of hydrated silica and hydrated alumina.

According to a fourth aspect of the invention, there is provided a process for the production of record material, comprising the steps of:

(a) forming an aqueous dispersion of a particulate composite having as components hydrated zirconia and at least one of hydrated silica and hydrated alumina;

(b) either:

(i) formulating said dispersion into a coating composition and applying the coating composition to a substrate web; or (ii) introducing said dispersion into papermaking stock and forming a paper web which incorporates said composite as a loading; and (c) drying the resulting coated or loaded web to produce said record material.

The relative proportions of the components of the composite (i.e. the hydrated zirconia, and either the hydrated silica or the hydrated alumina or both) may vary freely. For example, in the case of a hydrated zirconia/hydrated silica/hydrated alumina composite, these components may be present in approximately equal weight proportion, or any one may predominate, or any two of them may be present in much greater weight proportion than the third. In the case of a hydrated zirconia/hydrated silica composite or a hydrated zirconia/hydrated alumina composite, the hydrated zirconia may be present in major or minor proportion, or the hydrated zirconia and the hydrated silica or hydrated alumina may be present in approximately equal weight proportion.

Preferably however, the proportion of hydrated zirconia is at least 10% by weight of a dry weight basis, based on the total dry weight of zirconia and silica and/or alumina.

The composite may be synthesized by any of a variety of process routes.

One such route, which in general has been found to be most advantageous is to precipitate at least one of the components on to at least one other of the components. This is thought to result in at least one of the components of the composite (i.e. the later-precipitated component or components) being present in a greater proportion in a surface region of the composite than elsewhere. In the case of a bi-component composite, either of the components may be precipitated in the presence of the other.

Another such route is by precipitation of the components of the composite together from aqueous solution, i.e. from an aqueous solution of a zirconium-containing salt and either an aluminium-containing salt or a silicate salt or both.

A third route is by admixture of previously-formed components of the composite in an aqueous medium, i.e. by admixture of hydrated zirconia and either hydrated silica or hydrated alumina or both. Advantageously, at least one, and preferably all, of the admixed materials are freshly precipitated. At least where hydrated alumina is one of the components of the composite, it may be advantageous to admix the components in an alkaline medium.

In the case of a tri-component composite, any two of the components may be present in aqueous dispersion and the remaining component precipitated in their presence. The two components initially present may have been admixed, or precipitated previously, either together or sequentially. Alternatively, any two of the components may be precipitated from aqueous solution together or sequentially, in the presence of the third.

In a process in which one or more components are precipitated on to another component already in aqueous dispersion, the component already in dispersion may be a material produced in a separate production process, for example a commercially available material, or it may be a material which has been precipitated just previously as an earlier stage in a single process for producing the composite.

Precipitation of hydrated zirconia as part of any of the process routes just described is conveniently carried out by treating a solution of a zirconium salt, for example zirconyl chloride or zirconium sulphate, with an alkaline hydroxide, for example sodium, potassium, lithium or ammonium hydroxide.

Instead of the use of a cationic zirconium salt, hydrated zirconia may be precipitated from a solution of a zirconate, for example ammonium tris-carbonato zirconate, by addition of acid, for example a mineral acid such as sulphuric acid or hydrochloric acid.

Precipitation of hydrated alumina as part of any of the process routes just described is conveniently carried out by treating a solution of a cationic-aluminium salt with an alkaline material such as sodium or potassium hydroxide, although other alkaline materials may be used, for example lithium hydroxide, ammonium hydroxide or calcium hydroxide. It is normally convenient to use aluminium sulphate as the aluminium salt, but other aluminium salts may be used, for example aluminium acetate.

Instead of the use of a cationic aluminium salt, hydrated alumina may be precipitated from a solution of an aluminate, for example sodium or potassium aluminate, by addition of acid, e.g. a mineral acid such as sulphuric or hydrochloric acid.

Precipitation of hydrated silica as part of any of the process routes just described is conveniently carried out by treating a solution of sodium or potassium silicate with an acid, normally one of the common mineral acids such as sulphuric or hydrochloric acid.

The nature of the present colour developing composites has not been fully elucidated, but it is clear from the preparative routes described above that the hydrated zirconia and hydrated silica and/or hydrated alumina elements of the composite are at the least in intimate physical contact and may well be chemically reacted to a greater or lesser degree.

In a preferred embodiment of the present invention, the colour developing composite is modified by the presence of a compound or ions or one or more multivalent metals for example copper, nickel, manganese, cobalt, chromium, zinc, magnesium, titanium, tin, calcium, tungsten, iron, tantalum, molybdenum or niobium. Such modification will hereafter be referred to as "metal modification".

Metal modification may conveniently be brought about by treating the composite, once formed, with a solution of the metal salt, for example the sulphate or chloride. Alternatively, a solution of the metal salt may be introduced into the medium from which the composite or individual components thereof are deposited.

The precise nature of the species formed during metal-modification has not so far been fully elucidated, but one possibility is that a metal oxide or hydroxide is precipitated so as to be present in the composite. An alternative or additional possibility is that ion-exchange occurs so that metal ions are present at ion-exchange sites on the surface of the composite.

Metal modification enables improvements to be obtained in the initial intensity and/or fade resistance of the print obtained from the present colour developing composite with both so-called rapid-developing and so-called slow-developing colour formers, and with colour formers intermediate these categories.

Categorisation of colour formers according to the speed with which their colour may be developed has long been a common practice in the art. 3,3-Bis(4'-dimethylaminophenyl)-6-dimethylaminophthalide (CVL) and similar lactone colour formers are typical of the rapid-developing class, in which colour formation results from cleavage of the lactone ring on contact with an acid co-reactant. 10-Benzoyl-3,7-bis(dimethylamino)phenothiazine (more commonly known as benzoyl leuco methylene blue or BLMB) and 10-benzoyl-3,7-bis(diethylamino)phenoxazine (also known as BLASB) are examples of the slow-developing class. It is generally believed that formation of a colour species is a result of slow hydrolysis of the benzoyl group over a period of up to about two days, followed by aerial oxidation. Spiro-bipyran colour formers, which are widely disclosed in the patent literature, are examples of colour formers in the intermediate category.

The effect achieved by metal modification depends in substantial measure on the particular metal involved and on the particular colour former(s) being used, as will become clear from consideration of the Examples set out hereafter.

The production of the composite by any of the process routes described earlier may take place in the presence of a polymeric rheology modifier such as the sodium salt of carboxymethyl-cellulose (CMC), polyethyleneimine or sodium hexametaphosphate. The presence of such a material modifies the rheological properties of the resulting dispersion of the composite and thus results in a more easily agitatable, pumpable and coatable composition, possibly by having a dispersing or flocculating action. It may be advantageous to form the composite or one or more components thereof in the presence of a particulate material which may function as a carrier or nucleating agent. Suitable particulate materials for this purpose include kaolin, calcium carbonate or other materials commonly used as pigments, fillers or extenders in the paper coating art, since these materials will often need to be included in the coating composition used in the production of a coated record material or in the papermaking stock used in the production of a loaded record material.

A coating composition for use in the production of the present record material will normally also contain a binder (which may be wholly or in part constituted by the CMC optionally used during the preparation of the colour developing material) and/or a filler or extender, which typically is kaolin, calcium carbonate or a synthetic paper coating pigment, for example a urea-formaldehyde resin pigment. The filler or extender may be wholly or in part constituted by the particulate material which may be used during the preparation of the composite. In the case of a loaded record material, a filler or extender may also be present, and again this may be wholly or in part constituted by the particulate material which may be used during the preparation of the composite.

The pH of the coating composition influences the subsequent colour developing performance of the composition, and also its viscosity, which is significant in terms of the ease with which the composition may be coated on to paper or another substrate. The preferred pH for the coating composition is within the range 5 to 9.5, and is preferably around 7.0. Sodium hydroxide is conveniently used for pH adjustment, but other alkaline materials may be used, for example potassium hydroxide, lithium hydroxide, calcium hydroxide, ammonium hydroxide, sodium silicate, or potassium silicate.

The aqueous dispersion which is formulated into the coating composition or introduced into the papermaking stock may be the dispersion obtained as a result of synthesis of the composite in the aqueous medium. Alternatively, the composite may be separated after its synthesis, e.g. by filtering off, and then washed to remove soluble salts before being re-dispersed in a further aqueous medium to form the dispersion for formulation into the coating composition or introduction into the paper-making stock.

The present composite may be used as the only colour developing material in a colour developing composition, or it may be used together with other colour developing materials, e.g. an acid-washed dioctahedral montmorillonite clay, a phenolic resin, or a salicyclic acid derivative.

It is usually desirable to treat the composite in order to break up any aggregates which have formed, for example by ball-milling. This treatment may be carried out either before or after the optional addition of fillers and/or additional colour developing materials.

In the case of a coated record material, the record material may form part of a transfer or self-contained pressure-sensitive copying system or of a heat-sensitive recording system as described previously. In the case of a loaded record material, the record material may be used in the same manner as the coated record material just described, or the record material may also carry microencapsulated colour former solution as a loading, so as to be a self-contained record material.

The invention will now be illustrated by the following Examples (in which all percentages quoted are by weight):

EXAMPLE 1

This illustrates the production of a series of hydrated silica/hydrated zirconia/hydrated alumina composites with different relative proportions of hydrated silica, hydrated zirconia and hydrated alumina by a process in which the hydrated zirconia, hydrated silica and hydrated alumina are precipitated together from a common aqueous solution.

Z g of dry zirconyl chloride, $ZrOCl_2.8H_2O$ were dissolved in A g of a 40% w/w solution of aluminium sulphate, $Al_2(SO_4)_3.16H_2O$. S g of a solution of sodium silicate (Pyramid 120 supplied by Joseph Crosfield & Sons Ltd., but diluted from its as-supplied solids content of 48% to 24% solids content) were then added slowly, whilst maintaining the pH of the resulting mixture below 4.0. When all the sodium silicate solution has been added the pH of the mixture was adjusted to 7.0 using sodium hydroxide solution. The foregoing procedure resulted in formation of a slurry of a hydrated silica/hydrated zirconia/hydrated alumina composite. The slurry was ball milled by passage through a continuous laboratory ball mill, after which it was filtered. The material collected was washed with de-ionized water so as to remove substantially all water-soluble salts. The washed material was then re-dispersed in de-ionized water and 8.82 g of 50% solids content styrene-butadiene latex binder (that supplied by Dow as Dow 675 latex) were added, giving a 15% latex content on a dry weight basis in each case. Sufficient water was added to lower the viscosity of the mixture to a level suitable for coating using a laboratory Meyer Bar coater. The mixture was then coated on to paper at a nominal dry coatweight of 8 $gm^{-2}$, and the coated sheet was dried at 110° C. and calendered. The finished sheet was then subjected to calender intensity and fade resistance tests to assess its performance as a colour developing material.

The values of Z, A and S are set out below:

| | Z (g) | A (g) | S (g) |
|---|---|---|---|
| Run No. 1 | 43.2 | 254.8 | 103.1 |
| Run No. 2 | 26.2 | 154.4 | 187.5 |
| Run No. 3 | 26.2 | 463.2 | 62.5 |
| Run No. 4 | 78.5 | 154.4 | 62.5 |

The resulting silica, zirconia and alumina contents of the composite on a dry weight basis, based on the total dry weight of silica, zirconia and alumina are set out below:

| | % $SiO_2$ | % $ZrO_2$ | % $Al_2O_3$ |
|---|---|---|---|
| Run No. 1 | 33.3 | 33.3 | 33.3 |
| Run No. 2 | 60 | 20 | 20 |
| Run No. 3 | 20 | 20 | 60 |
| Run No. 4 | 20 | 60 | 20 |

The calender intensity test involved superimposing a strip of paper coated with encapsulated colour former solution on a strip of the coated paper under test, passing the superimposed strips through a laboratory calender to rupture the capsules and thereby produce a colour on the test strip, measuring the reflectance of the coloured strip (I) and expressing the results ($^{I}/_{Io}$) as a percentage of the reflectance of an unused control strip (Io). Thus the lower the calender intensity value ($^{I}/_{Io}$) the more intense the developed colour. The calender intensity tests were done with a paper ("Paper A") which employed a commercially used colour former blend containing, inter alia, CVL as a rapid-developing colour former and BLASB as a slow-developing colour former.

The reflectance measurements were done both two minutes after calendering and forty-eight hours after calendering, the sample being kept in the dark in the interim. The colour developed after two minutes is primarily due to the rapid-developing colour formers, whereas the colour after forty-eight hours derives also from the slow-developing colour formers (fading of the colour from the rapid-developing colour formers also influences the intensity achieved).

The fading test involved positioning the developed strips (after forty-eight hours development) in a cabinet in which were an array of daylight fluorescent striplamps. This is thought to simulate, in accelerated form, the fading which a print might undergo under normal conditions of use. After exposure for the desired time, measurements were made as described with reference to the calender intensity test, and the results were expressed in the same way.

The calender intensity and fade resistance results were as follows:

| Test Conditions | Run No. 1 | 2 | 3 | 4 |
|---|---|---|---|---|
| 2 min development | 34.1 | 41.0 | 35.1 | 33.9 |
| 48 hr development | 30.3 | 36.9 | 28.1 | 30.7 |
| 15 hr fade | 51.0 | 58.2 | 49.3 | 50.5 |
| Intensity Decline* | 20.7 | 21.3 | 21.2 | 19.8 |

*The "intensity decline" in this and subsequent Examples is a measure of the extent of fading from the intensity value reached after 48 hours dark development.

EXAMPLE 2

This illustrates metal modification of a hydrated silica/hydrated zirconia/hydrated alumina composite, produced by a process generally as described in Example 1, the particular modifying metal in this instance being copper. The procedure was as described in Example 1 (Run No. 1), except firstly that after adjustment of the pH to 7.0, 2.4 g of copper sulphate, $CuSO_4.5H_2O$ were added and the slurry was stirred for about 10 minutes, and secondly that 8.96 g of latex were used.

The resulting copper modification level was 1.5%, calculated as cupric oxide on a dry weight basis, based on the total dry weight of silica, zirconia, alumina and cupric oxide.

The calender intensity and fade resistance values were as follows:

| | |
|---|---|
| 2 min. development | 36.6 |
| 48 hr. development | 32.0 |
| 15 hr. fade | 48.3 |
| Intensity decline | 16.3 |

It will be seen that copper modification resulted in a slightly worse initial intensity but a significantly improved fade resistance (a fall of 16.3 points rather than 20.7 points).

EXAMPLE 3

This illustrates the production of a series of hydrated silica/hydrated zirconia/hydrated alumina composites with different relative proportions of hydrated silica, hydrated zirconia and hydrated alumina by a process in which freshly prepared hydrated silica, freshly prepared hydrated zirconia and freshly prepared hydrated alumina are admixed.

A master batch of hydrated silica slurry was prepared by neutralizing sodium silicate solution to pH 7.0 with 40% w/w sulphuric acid. The resulting hydrated silica precipitate was filtered off and washed with de-ionized water to remove water-soluble salts. The washed precipitate was then re-dispersed in de-ionized water and the resulting slurry was passed through a continuous laboratory ball-mill, after which it was filtered. The collected material was washed to remove any remaining water soluble salts, and then re-dispersed in de-ionized water. The solids content of the resulting slurry was measured and found to be 16.5%.

A master batch of hydrated alumina slurry was prepared by neutralizing a 40% w/w solution of aluminium sulphate, $Al_2(SO_4)_3.16H_2O$ to pH 7.0 by slow addition of 40% w/w sodium hydroxide solution with vigorous stirring. The resulting hydrated alumina precipitate was filtered off and washed twice with de-ionized water to remove water-soluble salts. The washed precipitate was then redispersed in de-ionized water and the resulting slurry was passed through a continuous laboratory ball-mill, after which it was filtered. The collected material was re-washed, re-dispersed and filtered off again, before final re-dispersion in de-ionized water. The solids content of the slurry was measured and found to be 12.5%.

A master batch of hydrated zirconia slurry was prepared by neutralizing a solution of zirconyl chloride, $ZrOCl_2.8H_2O$ to pH 7.0 with 40% w/w sodium hydroxide solution. The resulting hydrated zirconia precipitate was filtered off and washed with de-ionized water to remove water-soluble salts. The washed precipitate was then re-dispersed in de-ionized water and the resulting slurry was passed through a continuous laboratory ball-mill, after which it was filtered. The collected material was then re-dispersed in de-ionized water. The solids content of the resulting slurry was measured and found to be 19.1%.

S g of the hydrated silica slurry, A g of the hydrated alumina slurry and Z g of the hydrated zirconia slurry were then mixed and 7.5 g of latex (Dow 675) were added, giving a latex level of 15% on a dry weight basis in each case. The experimental and testing procedures from this point on were as described in Example 1.

The values of Z, A and S are set out below:

| | Z (g) | A (g) | S (g) |
|---|---|---|---|
| Run No. 1 | 43.2 | 66.0 | 50.0 |
| Run No. 2 | 78.6 | 40.0 | 30.3 |
| Run No. 3 | 26.2 | 40.0 | 90.9 |
| Run No. 4 | 26.2 | 120.0 | 30.3 |

The resulting silica, zirconia and alumina contents of the composite on a dry weight basis, based on the total dry weight of silica, zirconia and alumina are set out below:

| | % $SiO_2$ | % $ZrO_2$ | % $Al_2O_3$ |
|---|---|---|---|
| Run No. 1 | 33.3 | 33.3 | 33.3 |
| Run No. 2 | 20 | 60 | 20 |
| Run No. 3 | 60 | 20 | 20 |
| Run No. 4 | 20 | 20 | 60 |

The calender intensity and fade resistance results obtained were as follows:

| Test Conditions | Run No. 1 | 2 | 3 | 4 |
|---|---|---|---|---|
| 2 min. development | 43.9 | 51.0 | 45.9 | 52.6 |
| 48 hr. development | 42.0 | 46.5 | 43.2 | 49.1 |
| 15 hr. fade | 59.4 | 66.9 | 62.3 | 65.4 |
| Intensity decline | 17.4 | 20.4 | 19.1 | 16.3 |

EXAMPLE 4

This illustrates metal modification of a hydrated silica/hydrated zirconia/hydrated alumina composite produced by a process generally as described in Example 3, the particular modifying metal in this instance being copper. The procedure was as described in Example 3 (Run No. 4), except that before the latex addition, 1.08 g of copper sulphate, $CuSO_4.5H_2O$ were added and the slurry was stirred for 10 minutes.

The resulting copper modification level was 1.5% calculated on the same basis as in Example 2.

The calender intensity and fade resistance values were as follows:

| | |
|---|---|
| 2 min development | 51.9 |
| 48 hr. development | 48.8 |
| 15 hr. fade | 61.8 |
| Intensity decline | 13.0 |

It will be seen that copper modification resulted in improved fade resistance.

EXAMPLE 5

This illustrates the production of a hydrated zirconia/hydrated alumina composite in which hydrated zirconia predominates by a process in which hydrated zirconia and hydrated alumina are precipitated sequentially.

2.4 g of CMC (FF5 supplied by Finnfix) were dissolved in 210 g of de-ionized water over a period of 15 minutes with stirring. 90 g of zirconyl chloride, $ZrOCl_2.8H_2O$ were then added, giving an acidic solution, and 40% w/w sodium hydroxide solution was added slowly with stirring to restore the pH to 7.0, with resultant precipitation of hydrated zirconia. Approximately 60 g of the sodium hydroxide solution was required for this purpose. The mixture was left stirring for an hour, after which it was ball-milled overnight. The mixture was then split into five portions, four of 50 g and one of 60 g. X g of 40% w/w solution of aluminium sulphate, $Al_2(SO_4)_3.16H_2O$ were then added to each 50 g portion, and the pH of each mixture was readjusted to 7 by the addition of further sodium hydroxide solution. This resulted in precipitation of hydrated alumina onto the hydrated zirconia to form a hydrated zirconia/hydrated alumina composite. Each mixture was left stirring for an hour, after which 2.8 g of kaolin (Dinkie A supplied by English China Clays) were added (3.3 g in the case of the slurry to which aluminium sulphate solution had not been added). After stirring each mixture for a further 30 minutes, 2.8 g of latex (Dow 675) were added (3.3 g in the case of the slurry to which aluminium sulphate had not been added). After further stirring, the mixtures were coated onto respective sheets of paper at a nominal dry coatweight of 8 $gm^{-2}$ using a laboratory Meyer bar coater. The coated sheets were then dried and calendered and subjected to calender intensity and fade resistance tests to assess their performance as colour developing materials.

The values of X and the resulting alumina content of the hydrated zirconia/hydrated alumina composites, on a dried weight basis, based on the total dry weight of zirconia and alumina were as follows:

| Mix No. | X (g) | % $Al_2O_3$ |
|---|---|---|
| 1 | 0 | 0 |
| 2 | 8.1 | 10 |
| 3 | 8.1 | 10 |
| 4 | 18.3 | 20 |
| 5 | 48.8 | 40 |

The calender intensity test was generally as described in Example 1, except that testing was carried out with three different microcapsule coated papers. One of these was Paper A as described in Example 1. Another ("Paper B") employed an experimental colour former blend including CVL, a slow-developing blue colour former and an intermediate-developing colour former which was a spiro-bipyran derivative. The third paper ("Paper C") employed CVL as the sole colour former.

The results of the calender intensity and fade resistance tests were as follows:

| | Paper A | | | | |
|---|---|---|---|---|---|
| | % $Al_2O_3$ | | | | |
| Test Conditions | 0 | 10 (Mix 2) | 10 (Mix 3) | 20 | 40 |
| 2 min. development | 63.7 | 45.4 | 45.1 | 45.3 | 47.0 |
| 48 hour development | 44.7 | 37.8 | 37.4 | 37.2 | 37.7 |
| 1 hour fade | 44.0 | 37.9 | 37.7 | 36.7 | 36.1 |
| 15 hour fade | 63.5 | 56.3 | 54.3 | 50.4 | 52.2 |
| Intensity decline | 18.8 | 18.5 | 16.9 | 13.2 | 14.5 |

| | Paper B | | | | |
|---|---|---|---|---|---|
| | % $Al_2O_3$ | | | | |
| Test Conditions | 0 | 10 (Mix 2) | 10 (Mix 3) | 20 | 40 |
| 2 min. development | 68.5 | 50.7 | 50.8 | 45.3 | 52.0 |
| 48 hour development | 52.8 | 45.0 | 45.2 | 37.2 | 45.4 |
| 1 hour fade | 48.6 | 43.3 | 43.4 | 36.9 | 42.3 |
| 15 hour fade | 60.1 | 55.7 | 57.2 | 50.9 | 59.1 |
| Intensity decline | 7.3 | 10.7 | 12.0 | 13.7 | 13.7 |

| | Paper C | | | | |
|---|---|---|---|---|---|
| | % $Al_2O_3$ | | | | |
| Test Conditions | 0 | 10 (Mix 2) | 10 (Mix 3) | 20 | 40 |
| 2 min. development | 71.5 | 60.1 | 59.5 | 59.6 | 62.9 |
| 48 hour development | 62.4 | 57.1 | 57.3 | 56.6 | 58.4 |
| 1 hour fade | 66.1 | 59.1 | 59.2 | 58.0 | 66.4 |
| 15 hour fade | 89.6 | 80.2 | 79.8 | 76.9 | 77.7 |
| Intensity decline | 27.2 | 23.1 | 22.5 | 20.3 | 19.3 |

It will be seen that the inclusion of hydrated alumina improved the initial intensity and/or fade resistance obtained in each case.

EXAMPLE 6

This illustrates metal modification of a hydrated zirconia/hydrated alumina composite in which hydrated zirconia predominates and which is produced by a process generally as described in Example 5, using a variety of modifying metals.

1.2 g of CMC were dissolved in 105 g of de-ionized water over a period of 15 minutes with stirring. 45 g of zirconyl chloride, $ZrOcl_2.8H_2O$ were then added, giving an acidic solution, and 40% w/w sodium hydroxide solution was added slowly with stirring to restore the pH to 7.0, with resultant precipitation of hydrated zirconia. About 30 g of the sodium hydroxide solution was required for this purpose. The mixture was left stirring for an hour, after which 29.5 g of 40% w/w solution of aluminium sulphate $Al_2(SO_4)_3.16H_2O$ were added and the pH was readjusted to 7 by the addition of further sodium hydroxide solution. This resulted in precipitation of hydrated alumina. The mixture was left stirring for an hour, after which X g of a metal compound M were added. The pH was then re-adjusted to 7.0 by the addition of further sodium hydroxide solution, and stirring was continued for a further hour. Kaolin and latex were successively added (10 g in each case) following the procedure described in Example 5 and the compositions were coated onto paper and tested, as described in Example 5. A control procedure with no modifying metal compound was also carried out.

The value of X and the nature of M were as follows:

| X (g) | | M |
|---|---|---|
| 4.5 | Copper sulphate | $CuSO_4.5H_2O$ |
| 0.8 | Phosphomolybdic acid | $12MoO_3.H_3PO_4.24H_2O$ |
| 1.8 | Nickel chloride | $NiCl_2.6H_2O$ |
| 0.6 | Niobium pentoxide | $Nb_2O_5$ |
| 1.2 | Stannic chloride | $SnCl_4.5H_2O$ |
| 0.6 | Titanium dioxide | $TiO_2$ |
| 0.7 | Phosphotungstic acid | $H_3PO_4.12WO_3.xH_2O$ |
| 1.0 | Zinc chloride | $ZnCl_2$ |
| 1.6 | Ferrous chloride | $FeCl_2.4H_2O$ |

The results of calender intensity and fade resistance tests were as follows:

Paper A

| Test Conditions | Modifying metal None | Cu | Mo | Ni | Nb |
|---|---|---|---|---|---|
| 2 min. development | 48.0 | 46.3 | 46.9 | 48.8 | 46.1 |
| 48 hour development | 38.0 | 39.4 | 41.0 | 40.6 | 37.7 |
| 1 hour fade | 41.0 | 40.1 | 42.6 | 42.3 | 40.5 |
| 3 hour fade | 51.3 | 42.8 | 48.4 | 47.2 | 45.7 |
| 5 hour fade | 55.0 | 45.9 | 55.3 | 51.6 | 53.4 |
| 10 hour fade | 63.5 | 49.7 | 63.4 | 59.2 | 61.6 |
| 15 hour fade | 73.0 | 60.0 | 73.0 | 69.1 | 71.3 |
| Intensity decline | 35.0 | 20.6 | 32.0 | 28.5 | 33.6 |

| Test Conditions | Modifying metal Sn | Ti | W | Zn | Fe |
|---|---|---|---|---|---|
| 2 min. development | 46.2 | 48.2 | 47.7 | 44.0 | 47.6 |
| 48 hour development | 40.8 | 40.9 | 39.8 | 37.4 | 38.5 |

-continued

| Test Conditions | Modifying metal Sn | Ti | W | Zn | Fe |
|---|---|---|---|---|---|
| 1 hour fade | 40.6 | 41.5 | 41.4 | 40.8 | 42.2 |
| 3 hour fade | 45.0 | 46.1 | 47.4 | 47.2 | 56.7 |
| 5 hour fade | 50.0 | 52.7 | 53.7 | — | — |
| 10 hour fade | 60.2 | 63.8 | 64.8 | — | — |
| 15 hour fade | 67.5 | 69.8 | 70.7 | — | — |
| Intensity decline | 26.7 | 28.9 | 30.9 | 9.8 (3 hrs) | 18.2 (3 hrs) |

Paper B

| Test Conditions | Modifying metal None | Cu | Mo | Ni | Nb |
|---|---|---|---|---|---|
| 2 min. development | 54.6 | 51.0 | 56.6 | 58.0 | 55.5 |
| 48 hour development | 45.5 | 45.7 | 49.8 | 49.0 | 46.7 |
| 1 hour fade | 46.6 | 46.3 | 48.2 | 47.7 | 45.8 |
| 3 hour fade | 55.6 | 48.4 | 51.9 | 50.7 | 49.6 |
| 5 hour fade | — | 50.3 | 56.6 | 54.1 | 53.9 |
| 10 hour fade | — | 54.1 | 62.5 | 59.3 | 59.6 |
| 15 hour fade | — | 60.3 | 72.6 | 66.3 | 66.1 |
| Intensity decline | 10.1 (3 hrs) | 14.6 | 22.8 | 17.3 | 19.4 |

| Test Conditions | Modifying metal Su | Ti | W | Zn | Fe |
|---|---|---|---|---|---|
| 2 min. development | 55.1 | 55.7 | 56.9 | 50.7 | 53.5 |
| 48 hour development | 48.9 | 48.3 | 48.4 | 44.4 | 45.5 |
| 1 hour fade | 47.2 | 47.7 | 47.9 | 44.9 | 45.9 |
| 3 hour fade | 50.6 | 52.1 | 50.6 | 50.0 | 55.5 |
| 5 hour fade | 55.3 | 57.4 | 56.7 | — | — |
| 10 hour fade | 62.7 | 64.0 | 64.2 | — | — |
| 15 hour fade | 66.0 | 68.0 | 67.9 | — | — |
| Intensity decline | 17.1 | 19.7 | 19.5 | 5.6 (3 hrs) | 10.0 (3 hrs) |

Paper C

| Test Conditions | Modifying metal None | Cu | Mo | Ni | Nb |
|---|---|---|---|---|---|
| 2 min. development | 62.8 | 62.5 | 63.2 | 62.8 | 61.8 |
| 48 hour development | 58.7 | 59.4 | 58.8 | 59.3 | 58.4 |
| 1 hour fade | 63.8 | 60.0 | 64.6 | 62.0 | 63.7 |
| 3 hour fade | 76.9 | 63.4 | 72.5 | 66.6 | 70.4 |
| 5 hour fade | 79.2 | 65.7 | 77.9 | 70.8 | 75.7 |
| 10 hour fade | 88.1 | 71.8 | 86.1 | 77.4 | 84.7 |
| 15 hour fade | 95.0 | 81.7 | 94.3 | 86.5 | 93.5 |
| Intensity decline | 36.3 | 22.3 | 35.5 | 27.2 | 35.1 |

| Test Conditions | Modifying metal Sn | Ti | W | Zn | Fe |
|---|---|---|---|---|---|
| 2 min. development | 63.3 | 63.7 | 62.6 | 60.8 | 62.5 |
| 48 hour development | 59.4 | 59.4 | 58.5 | 56.8 | 58.1 |
| 1 hour fade | 62.8 | — | 64.7 | 62.5 | 63.0 |
| 3 hour fade | 66.0 | — | 70.5 | 72.8 | 77.7 |
| 5 hour fade | 71.3 | — | 76.1 | — | 80.0 |
| 10 hour fade | 80.9 | — | 89.4 | — | 87.5 |
| 15 hour fade | 87.3 | 82.6 | 93.1 | — | 93.8 |
| Intensity decline | 27.9 | 23.2 | 34.6 | 16.0 (3 hrs) | 35.7 |

It will be seen that whilst some metals are much more effective as modifiers than others, all of them gave improved performance in at least some respects.

EXAMPLE 7

This illustrates the production of a hydrated zirconia/hydrated silica composite in which hydrated silica predominates by a process in which freshly precipitated hydrated zirconia is admixed with hydrated silica.

50 g of zirconyl chloride, $ZrOCl_2.8H_2O$ were dissolved in 100 g de-ionized water. This solution was neutralized to pH 7.0 by the addition of aqueous ammonia, and the resulting hydrated zirconia precipitate was filtered off and washed with de-ionized water to remove soluble salts. This preparative procedure was carried out six times in all to produce six batches of hydrated zirconia. The zirconia content on a dry weight basis was measured and found to be 19.1%.

A series of parallel experiments was then carried out in which X g of one batch of the hydrated zirconia were dispersed in 50 g de-ionized water and Y g of hydrated silica were added.

The mixture was stirred for an hour and the pH was readjusted to 7.0 (if necessary). Z g of a 50% solids content styrene butadiene latex binder (Dow 675) were added with stirring. The experimental and test procedures from this point on were as described in Example 1. Control experiments with no hydrated silica addition and with no hydrated zirconia present were also carried out for comparison purposes.

The values of X, Y and Z and the silica content of the composite on a dried weight basis, based on the total dry weight of silica and zirconia, are set out below:

| X (g) | Y (g) | Z (g) | % $SiO_2$ |
|---|---|---|---|
| 100 | 0 | 8 | 0 |
| 110 | 11.2 | 8.6 | 10 |
| 105 | 25.3 | 9.4 | 20 |
| 100 | 43.4 | 10.0 | 30 |
| 105 | 67.3 | 11.2 | 40 |
| 105 | 101.1 | 13.2 | 50 |

The calender intensity and fade resistance results were as follows:

| Test | % $SiO_2$ | | | | | | |
|---|---|---|---|---|---|---|---|
| Conditions | 0 | 10 | 20 | 30 | 40 | 50 | 100 |
| 2 min. development | 61.0 | 48.8 | 48.5 | 48.6 | 46.8 | 46.4 | 55.0 |
| 48 hour development | 54.6 | 40.9 | 41.9 | 42.1 | 40.5 | 40.9 | 54.8 |
| 15 hour fade | 77.1 | 69.3 | 70.6 | 72.3 | 73.5 | 75.4 | 81.5 |
| Intensity decline | 22.5 | 28.4 | 28.7 | 30.2 | 33.0 | 34.5 | 26.7 |

It will be seen that the inclusion of hydrated silica resulted in enhanced initial intensity, compared with hydrated zirconia alone. It will also be noted that the colour developing performance of the composite was superior to that of hydrated silica alone.

EXAMPLE 8

This illustrates metal modification of a hydrated zirconia/hydrated silica composite produced by a process generally as described in Example 7, using a variety of modifying metals.

Batches of hydrated zirconia/hydrated silica composite containing 10% silica on a dried weight basis, based on the total dry weight of zirconia and silica, were prepared as in Example 7, except that X g of a metal compound M were added prior to the final pH adjustment and latex addition. A control batch with no metal compound addition was also prepared for comparison purposes. Coated sheets were then prepared and tested as described in Example 1.

The values of X g and the nature of M were as follows:

| X (g) | M | |
|---|---|---|
| 0.81 | Ferrous sulphate | $FeSO_4.7H_2O$ |
| 0.82 | Cobalt sulphate | $CoSO_4.7H_2O$ |
| 0.81 | Nickel sulphate | $NiSO_4.7H_2O$ |
| 0.73 | Copper sulphate | $CuSO_4.5H_2O$ |
| 0.39 | Calcium sulphate | $CaSO_4$ (anhydrous) |
| 0.71 | Magnesium sulphate | $MgSO_4.7H_2O$ |
| 0.83 | Zinc sulphate | $ZnSO_4.7H_2O$ |

The calender intensity and fade resistance results obtained were as follows:

| Test | Metal | | | | | | | |
|---|---|---|---|---|---|---|---|---|
| Conditions | — | Fe | Co | Ni | Cu | Ca | Mg | Zn |
| 2 min. development | 48.8 | 44.3 | 44.8 | 48.2 | 39.5 | 46.7 | 43.9 | 44.3 |
| 48 hour development | 40.9 | 39.1 | 38.6 | 40.1 | 33.1 | 39.3 | 38.5 | 39.1 |
| 15 hour fade | 69.3 | 63.3 | 55.0 | 60.8 | 47.5 | 64.4 | 69.2 | 65.3 |
| Intensity decline | 28.4 | 24.2 | 16.4 | 20.7 | 14.4 | 25.1 | 30.7 | 26.2 |

It will be seen that metal modification enhanced initial intensity and/or fade resistance.

EXAMPLE 9

This illustrates the production of a hydrated zirconia/hydrated silica composite in which hydrated zirconia predominates by a process in which hydrated zirconia is precipitated on to freshly-precipitated hydrated silica.

A master batch of hydrated silica slurry was first prepared by neutralizing sodium silicate solution (Pyramid 120 supplied by Joseph Crosfield & Sons Ltd. at 48% solids content) to pH 7.0 with 40% w/w sulphuric acid. The resulting hydrated silica precipitate was filtered off and washed three times with de-ionized water so as to remove substantially all water-soluble salts. The washed precipitate was then re-dispersed in de-ionized water. The silica content on a dry weight basis was checked and found to be approximately 20%.

Two parallel experiments were then carried out in which X g of zirconyl chloride, $ZrOCl_2.8H_2O$ were added in each case to an amount of the above-prepared hydrated slurry equivalent to Y g silica on a dry weight basis. The pH was then adjusted to 7.0 with 10N sodium hydroxide solution, with resultant formation of a hydrated zirconia/hydrated silica composite. Z g of 50% solids content styrene-butadiene latex binder (Dow 675) were added. The value of Z g was selected to give an equivalent binder level in each case (15% on a dry weight basis). The experimental and test procedures from this point on were as described in Example 1.

The values of X, Y and Z and the zirconia content of the composite on a dry weight basis, based on the total dry weight of zirconia and silica, are set out below:

| X | Y | Z | % $ZrO_2$ |
|---|---|---|---|
| 0 | 25.0 | 7.5 | 0 |
| 26.9 | 7.5 | 5.4 | 57.7 |
| 38.6 | 6.3 | 5.7 | 67.2 |

The calender intensity and fade resistance results were as follows:

| Test Conditions | % $ZrO_2$ 57.7 | 67.2 | 0 |
|---|---|---|---|
| 2 min. development | 50.1 | 54.8 | 47.1 |
| 48 hour development | 44.8 | 44.9 | 36.6 |
| 15 hour fade | 70.3 | 70.7 | 76.4 |
| Intensity decline | 25.5 | 25.8 | 39.8 |

It will be seen that the composite gave much improved fade resistance compared with hydrated silica alone.

EXAMPLE 10

This illustrates the production of a series of hydrated zirconia/hydrated alumina composites in which hydrated alumina predominates (or, in one case, in which the hydrated zirconia and hydrated alumina are present in equal weight proportions) by a process in which hydrated zirconia is precipitated on to freshly-precipitated hydrated alumina.

A master batch of hydrated alumina slurry was first prepared by neutralizing a 40% w/w solution of aluminium sulphate, $Al_2(SO_4)_3.16H_2O$ to pH 7.0 by the slow addition with vigorous stirring of 10N sodium hydroxide solution. The resulting hydrated alumina precipitate was filtered off and washed three times with de-ionized water so as to remove substantially all water-soluble salts. The washed precipitate was then redispersed in de-ionized water, and the resulting slurry was ball-milled to reduce the median particle size from an initial value of approximately 8 μm to approximately 4 μm (as measured by a Coulter Counter). The alumina content on a dry weight basis was then checked and found to be approximately 22.8%.

A series of parallel experiments was then carried out in which X g of zirconyl chloride, $ZrOCl_2.8H_2O$ were added in each case to 100 g of the above-prepared hydrated alumina slurry (equivalent to 22.8 g alumina on a dry weight basis). The pH was then adjusted to 7.0 by the addition of 10N sodium hydroxide solution, with resultant formation of a hydrated alumina/hydrated zirconia composite. This was filtered off and washed with de-ionized water to remove soluble salts. The washed material was then re-dispersed in de-ionized water and Y g of latex binder (Dow 675) were added. The value of Y was selected to give an equivalent binder level in each case. The experimental and test procedures from this point on were as described in Example 1. A control experiment with no zirconyl chloride addition was also carried out for comparison purposes.

The values of X and Y and the zirconia content of the composite on a dry weight basis, based on the total dry weight of zirconia and alumina, are set out below:

| X (g) | Y (g) | % $ZrO_2$ |
|---|---|---|
| 0 | 8.05 | 0 |

-continued

| X (g) | Y (g) | % $ZrO_2$ |
|---|---|---|
| 6.61 | 8.94 | 10 |
| 14.82 | 10.06 | 20 |
| 25.54 | 11.50 | 30 |
| 39.67 | 13.41 | 40 |
| 59.51 | 16.10 | 50 |

The calender intensity and fade resistance results were as follows:

| Test Conditions | % $ZrO_2$ 0 | 10 | 20 | 30 | 40 | 50 |
|---|---|---|---|---|---|---|
| 2 min. development | 43.3 | 39.3 | 40.7 | 40.2 | 39.0 | 37.9 |
| 48 hours development | 36.3 | 32.9 | 33.8 | 33.7 | 33.8 | 32.7 |
| 15 hours fade | 65.3 | 50.1 | 50.4 | 52.0 | 56.5 | 57.6 |
| Intensity decline | 29.0 | 17.2 | 16.6 | 18.3 | 22.7 | 24.9 |

It will be seen that the presence of hydrated zirconia improved the initial intensity and fade resistance in all cases, compared with hydrated alumina alone.

EXAMPLE 11

This illustrates metal modification of a hydrated zirconia/hydrated alumina composite produced by a process generally as described in Example 10, using a variety of modifying metals.

A master batch of hydrated zirconia/hydrated alumina composite having a 20% zirconia content on a dried weight basis, based on the total dry weight of zirconia and alumina, was made up by the method described in Example 10, except that larger quantities were used. The composite was found to have a solids content of 18.3%.

A series of parallel experiments was then carried out in which X g of a metal compound M were added in each case to 150 g of the composite. The resulting slurry was filtered, and the filtered off material was washed with de-ionized water to remove soluble salts. The washed material was then redispersed in de-ionized water and 9.69 g of latex binder (Dow 675) were added. The experimental and test procedures from this point on were as described in Example 1. A control experiment with no metal-modification was also carried out for comparison purposes.

The value of X and the nature of M were as set out below (it should be noted that the value of X was chosen to give a 1.5% metal modification level on a dried weight basis, calculated as the weight of metal oxide in relation to the total weight of zirconia, alumina and metal oxide).

| X (g) | M | |
|---|---|---|
| 1.63 | Ferrous sulphate | $FeSO_4.7H_2O$ |
| 1.63 | Cobalt sulphate | $CoSO_4.7H_2O$ |
| 1.63 | Nickel sulphate | $NiSO_4.7H_2O$ |
| 1.31 | Copper sulphate | $CuSO_4.5H_2O$ |
| 2.57 | Magnesium sulphate | $MgSO_4.7H_2O$ |
| 1.63 | Calcium chloride | $CaCl_2.6H_2O$ |
| 1.49 | Zinc sulphate | $ZnSO_4.7H_2O$ |

The results obtained were as follows:

| Test Conditions | Metal — | Fe | Co | Ni | Cu | Mg | Ca | Zn |
|---|---|---|---|---|---|---|---|---|
| 2 min. | 35.7 | 36.0 | 36.5 | 35.4 | 34.9 | 33.5 | 33.3 | 33.6 |

-continued

| Test Conditions | Metal — | Fe | Co | Ni | Cu | Mg | Ca | Zn |
|---|---|---|---|---|---|---|---|---|
| development | | | | | | | | |
| 48 hour development | 29.6 | 29.4 | 31.8 | 31.4 | 29.3 | 29.4 | 29.4 | 29.1 |
| 15 hour fade | 53.3 | 55.6 | 56.3 | 55.5 | 50.6 | 54.5 | 56.5 | 52.0 |
| Intensity decline | 23.7 | 26.2 | 24.5 | 24.1 | 21.3 | 25.1 | 27.1 | 22.9 |

It will be seen that in this instance, exceptionally, metal modification appeared to have little or no effect.

EXAMPLE 12

This illustrates the production of a series of hydrated zirconia/hydrated silica composites in which hydrated silica predominates by a process in which hydrated zirconia is precipitated on to freshly-precipitated hydrated silica.

A master batch of hydrated silica slurry was first prepared by neutralizing sodium silicate solution (Pyramid 120) to pH 7.0 with 40% w/w sulphuric acid. The resulting hydrated silica precipitate was filtered off and washed three times with de-ionized water so as to remove substantially all water-soluble salts. The washed precipitate was then re-dispersed in de-ionized water. The silica content on a dry weight basis was checked and found to be approximately 20%.

A series of parallel experiments was then carried out in which X g of zirconyl chloride, $ZrOCl_2.8H_2O$ were added in each case to an amount of the above-prepared hydrated slurry equivalent to Y g silica on a dry weight basis. The pH was then adjusted to 7.0 with 10N sodium hydroxide solution, with resultant formation of a hydrated zirconia/hydrated silica composite. Z g of latex binder (Dow 675) were added. The value of Z g was selected to give an equivalent binder level in each case (15% on a dry weight basis). The experimental and test procedures from this point on were as described in Example 1. A control experiment with no zirconyl chloride solution was also carried out for comparison purposes.

The values of X, Y and Z and the zirconia content of the composite on a dry weight basis, based on the total dry weight of silica and zirconia, are set out below:

| X (g) | Y (g) | Z (g) | % $ZrO_2$ |
|---|---|---|---|
| 0 | 25.0 | 7.5 | 0 |
| 13.4 | 22.5 | 8.3 | 18.5 |
| 26.8 | 20.0 | 9.1 | 34.0 |
| 20.2 | 8.8 | 5.0 | 46.8 |

The calender intensity and fade resistance results were as follows:

| Test Conditions | % $ZrO_2$ 0 | 18.5 | 34.0 | 46.8 |
|---|---|---|---|---|
| 2 min. development | 47.1 | 44.8 | 40.5 | 47.4 |
| 48 hour development | 36.6 | 36.7 | 34.5 | 40.3 |
| 15 hour fade | 76.4 | 62.2 | 56.7 | 64.4 |
| Intensity decline | 39.8 | 25.5 | 22.2 | 24.1 |

It will be seen that the presence of hydrated zirconia improved the initial intensity and/or fade resistance in all cases, compared with hydrated silica alone.

EXAMPLE 13

This illustrates metal modification of a hydrated zirconia/hydrated silica composite produced by a process generally as described in Example 12, using a variety of modifying metals.

A series of parallel experiments was carried out in which 50 g of hydrated silica (20% solids content) prepared by the method described in Example 12 was added to a solution of 13.4 g of zirconyl chloride, $ZrOCl_2.8H_2O$ in 20 g de-ionized water. The pH was then adjusted to 7.0 using 10N sodium hydroxide solution, with resultant formation of a hydrated silica/hydrated zirconia composite. A solution of X g of a metal compound M in a small amount of de-ionized water was added and the pH was re-adjusted to 7.0. 5.4 g of latex binder (Dow 675) were added, to give a binder level of 15% on a dry weight basis. The experimental and test procedures from this point on were as described in Example 1.

The value of X and the nature of M were as set out below (it should be noted that the value of X g was chosen to give a 1.5% metal modification level on a dry weight basis, calculated as the weight of metal oxide in relation to the total weight of zirconia, silica and metal oxide).

| X (g) | M | |
|---|---|---|
| 1.76 | Ferrous sulphate | $FeSO_4.7H_2O$ |
| 1.78 | Cobalt sulphate | $CoSO_4.7H_2O$ |
| 1.78 | Nickel sulphate | $NiSO_4.7H_2O$ |
| 1.58 | Copper sulphate | $CuSO_4.5H_2O$ |
| 0.86 | Calcium sulphate | $CaSO_4$, anhydrous |
| 1.56 | Magnesium sulphate | $MgSO_4.7H_2O$ |
| 1.82 | Zinc sulphate | $ZnSO_4.7H_2O$ |

The calendar intensity and fade resistance results obtained were as follows:

| Test Conditions | metal Fe | Co | Ni | Cu | Ca | Mg | Zn |
|---|---|---|---|---|---|---|---|
| 2 min. development | 38.6 | 42.7 | 42.5 | 38.8 | 39.6 | 42.6 | 47.6 |
| 48 hour development | 33.5 | 38.6 | 36.8 | 34.6 | 34.8 | 37.1 | 43.1 |
| 15 hour fade | 57.9 | 55.1 | 52.9 | 54.3 | 58.5 | 58.3 | 60.1 |
| Intensity decline | 24.4 | 16.5 | 16.1 | 19.7 | 23.7 | 21.2 | 17.0 |

EXAMPLE 14

This illustrates the production of a series of hydrated zirconia/hydrated silica composites by a process in which the hydrated zirconia and hydrated silica are precipitated from solution together.

Z g of 30% w/w solution of zirconyl chloride $ZrOCl_2.8H_2O$ were slowly added to 5 g of 30% w/w solution of sodium silicate (3.2:1 $SiO_2$:$Na_2O$) with stirring and the pH of the resulting mixture was adjusted to 7.0 using 20% w/w sulphuric acid. This resulted in precipitation of a hydrated zirconia/hydrated silica composite. The precipitate was filtered off, washed twice with de-ionized water so as to remove soluble salts, and re-dispersed in de-ionized water. This dispersion was then ball-milled to give a mean particle size of approximately 4 μm (as measured by a Coulter Counter). 17.65 g of latex binder (Dow 675) were added which gave a 15% latex content on a dry weight basis. The experimental and test procedures from this point on were as described in Example 1, except that different test papers were used, namely Paper D which utilised CVL as the sole colour former, Paper E which utilised a slow developing blue colour former (Pergascript Blue BP 558 supplied by Ciba-Geigy) as the sole colour former, and Paper F which utilised a commercially used blend of colour formers including CVL and a slow-developing blue colour former.

The values of Z and S and the zirconia content of the composite on a dry weight basis, based on the total dry weight of zirconia and silica were as follows:

| Z (g) | S (g) | % $ZrO_2$ |
|---|---|---|
| 87.26 | 200.00 | 20 |
| 174.53 | 150.00 | 40 |
| 261.79 | 100.00 | 60 |
| 349.05 | 50.00 | 80 |

The calender intensity and fade resistance results were as follows:

| Test Conditions | Paper D % $ZrO_2$ 20 | 40 | 60 | 80 |
|---|---|---|---|---|
| 2 min. development | 57.2 | 53.5 | 50.3 | 50.4 |
| 48 hour development | 46.1 | 46.1 | 46.6 | 47.6 |
| 15 hour fade | 94.6 | 93.7 | 82.8 | 82.8 |
| Intensity decline | 48.5 | 47.6 | 36.2 | 39.9 |

| Test Conditions | Paper E % $ZrO_2$ 20 | 40 | 60 | 80 |
|---|---|---|---|---|
| 2 min. development | — | — | — | — |
| 48 hour development | 60.5 | 64.0 | 60.7 | 62.9 |
| 15 hour fade | 66.4 | 63.8 | 65.0 | 77.0 |
| Intensity decline | 5.9 | −0.2 | 4.3 | 14.1 |

| Test Conditions | Paper F % $ZrO_2$ 20 | 40 | 60 | 80 |
|---|---|---|---|---|
| 2 min. development | 46.4 | 42.4 | 41.4 | 39.8 |
| 48 hour development | 36.1 | 35.5 | 37.0 | 37.6 |
| 15 hour fade | 76.9 | 73.7 | 61.6 | 64.7 |
| Intensity decline | 40.8 | 38.2 | 24.6 | 27.1 |

EXAMPLE 15

This illustrates the production of a series of hydrated zirconia/hydrated silica/hydrated alumina composites by a process in which the hydrated zirconia and hydrated silica are first precipitated from solution together and hydrated alumina is then precipitated on to the hydrated zirconia/hydrated silica composite so formed.

The procedure was as described in Example 14 except that after precipitation of the hydrated zirconia/hydrated silica composite, A g of 40% w/w solution of aluminium sulphate, $Al_2(SO_4)_3.16H_2O$ were added and the pH was readjusted to 7.0 using 10N sodium hydroxide solution. The precipitate was then filtered off and the subsequent procedure was as in Example 14, except that no tests were made using Paper E, except for Composition No. 7 (see below).

The values of Z, S and A, and the relative proportions of zirconia, silica and alumina in the composite on a dry weight basis, based on the total dry weight of zirconia, silica and alumina were as follows:

| Composition | Z (g) | S (g) | A (g) | $ZrO_2$:$SiO_2$:$Al_2O_3$ (%) |
|---|---|---|---|---|
| 1 | 87.26 | 150.00 | 154.41 | 20:60:20 |
| 2 | 87.26 | 100.00 | 308.82 | 20:40:40 |
| 3 | 87.26 | 50.00 | 463.23 | 20:20:60 |
| 4 | 174.53 | 100.00 | 154.41 | 40:40:20 |
| 5 | 174.53 | 50.00 | 308.82 | 40:20:40 |
| 6 | 261.79 | 50.00 | 154.41 | 60:20:20 |
| 7 | 145.44 | 83.33 | 257.35 | 33.3:33.3:33.3 |

The calender intensity and fade resistance results were as follows:

| Test Conditions | Paper D Compositon No. 1 | 2 | 3 | 4 | 5 | 6 | 7 |
|---|---|---|---|---|---|---|---|
| 2 min. development | 54.3 | 51.8 | 51.8 | 52.5 | 51.4 | 51.8 | 50.3 |
| 48 hour development | 45.0 | 45.9 | 44.3 | 47.0 | 46.4 | 44.9 | 46.3 |
| 15 hour fade | 75.5 | 69.0 | 68.8 | 77.5 | 70.7 | 73.9 | 82.4 |
| Intensity decline | 30.5 | 24.1 | 24.5 | 30.5 | 24.3 | 29.0 | 36.1 |

For Paper E and the coated paper made using Composition No. 7, the results were:

| | |
|---|---|
| 48 hour development | 59.6 |
| 15 hour fade | 66.8 |
| Intensity decline | 7.2 |

(No measurement was made after 2 min. development).

| Test Conditions | Paper F Composition No. 1 | 2 | 3 | 4 | 5 | 6 | 7 |
|---|---|---|---|---|---|---|---|
| 2 min. development | 42.4 | 41.6 | 39.9 | 38.0 | 37.8 | 39.1 | 38.9 |
| 48 hour development | 34.0 | 35.5 | 34.0 | 33.9 | 34.5 | 33.6 | 34.9 |
| 15 hour fade | 47.0 | 49.7 | 51.9 | 55.6 | 56.9 | 57.6 | 61.9 |
| Intensity decline | 13.0 | 14.2 | 17.9 | 21.7 | 22.4 | 24.0 | 27.0 |

EXAMPLE 16

This illustrates the production of a series of hydrated zirconia/hydrated silica/hydrated alumina composites by a process in which hydrated alumina and hydrated silica are first precipitated from solution together and hydrated zirconia is then precipitated on to the hydrated zirconia/hydrated silica composite so formed.

A g of 40% w/w solution of aluminium sulphate $Al_2(SO_4)_3.16H_2O$ were slowly added to S g of 30% w/w solution of sodium silicate (3.2:1 $SiO_2$:$Na_2O$), with stirring, and the pH of the resulting mixture was adjusted to 7.0 using 20% w/w sulphuric acid. This resulted in precipitation of a hydrated silica/hydrated alumina composite. Z g of 30% w/w solution of zirconyl chloride $ZrOCl_2.8H_2O$ were then added and the pH was readjusted to 7.0 using 10N sodium hydroxide solution, with resultant precipitation of hydrated zirconia. The composite precipitate was filtered off and the procedure from this point was as in Example 15.

The values of Z, S and A, and the proportions of zirconia:silica:alumina in the composite on a dry weight basis were the same as in Example 15.

The calender intensity and fade resistance results were as follows:

| Test Conditions | Paper D Composition No. 1 | 2 | 3 | 4 | 5 | 6 | 7 |
|---|---|---|---|---|---|---|---|
| 2 min. development | 48.8 | 48.7 | 48.3 | 49.3 | 49.0 | 47.4 | 51.8 |
| 48 hour development | 46.5 | 45.6 | 44.3 | 45.4 | 44.4 | 44.9 | 49.2 |
| 15 hour fade | 78.6 | 72.3 | 70.2 | 77.2 | 75.3 | 74.7 | 85.2 |
| Intensity decline | 32.1 | 26.1 | 25.9 | 31.8 | 30.9 | 29.8 | 36.0 |

| Test Conditions | Paper E Composition No. 1 | 2 | 3 | 4 | 5 | 6 | 7 |
|---|---|---|---|---|---|---|---|
| 2 min. development | — | — | — | — | — | — | — |
| 48 hour development | 62.1 | 60.4 | 66.5 | 63.9 | 60.7 | 63.5 | 62.7 |
| 15 hour fade | 60.9 | 60.9 | 66.6 | 63.1 | 63.6 | 68.6 | 71.9 |
| Intensity decline | −1.2 | 0.5 | 0.1 | −0.8 | 2.9 | 5.1 | 9.2 |

| Test Conditions | Paper F Composition No. 1 | 2 | 3 | 4 | 5 | 6 | 7 |
|---|---|---|---|---|---|---|---|
| 2 min. development | 37.1 | 37.3 | 37.2 | 38.8 | 35.3 | 37.4 | 40.7 |
| 48 hour development | 34.1 | 33.6 | 33.7 | 34.8 | 32.2 | 33.8 | 35.8 |
| 15 hour fade | 53.2 | 49.6 | 52.1 | 56.9 | 50.9 | 57.5 | 66.9 |
| Intensity decline | 19.1 | 16.0 | 18.4 | 22.1 | 18.7 | 13.7 | 31.1 |

EXAMPLE 17

This illustrates the production of a series of hydrated zirconia/hydrated alumina composites by a process in which hydrated zirconia and hydrated alumina are precipitated from solution together.

A g of 40% w/w solution of aluminium sulphate, $Al_2(SO_4)_3.16H_2O$ were added to Z g of 30% w/w solution of zirconyl chloride $ZrOCl_2.8H_2O$ with stirring, and the pH of the resulting mixture was adjusted to 7.0 using 10N sodium hydroxide solution. This resulted in precipitation of a hydrated zirconia/hydrated alumina composite. The procedure from this point on was as in Example 14.

The values of A and Z and the zirconia content of the composite on a dry weight basis, based on the total dry weight of zirconia and silica were as follows:

| A (g) | Z (g) | % $ZrO_2$ |
|---|---|---|
| 617.64 | 87.26 | 20 |
| 463.23 | 174.53 | 40 |
| 308.82 | 261.79 | 60 |
| 154.41 | 349.05 | 80 |

The calendar intensity and face resistance results were as follows:

| Test Conditions | Paper D % $ZrO_2$ 20 | 40 | 60 | 80 |
|---|---|---|---|---|
| 2 min. development | 53.4 | 52.9 | 51.2 | 48.2 |

-continued

| Test Conditions | Paper D % $ZrO_2$ 20 | 40 | 60 | 80 |
|---|---|---|---|---|
| 48 hour development | 46.5 | 45.5 | 45.4 | 44.3 |
| 15 hour fade | 89.1 | 83.7 | 82.7 | 85.9 |
| Intensity decline | 42.6 | 38.2 | 37.3 | 41.6 |

| Test Conditions | Paper E % $ZrO_2$ 20 | 40 | 60 | 80 |
|---|---|---|---|---|
| 2 min. development | — | — | — | — |
| 48 hour development | — | — | 62.4 | 63.3 |
| 15 hour fade | — | — | 53.1 | 85.1 |
| Intensity decline | — | — | 20.7 | 24.8 |

| Test Conditions | Paper F % $ZrO_2$ 20 | 40 | 60 | 80 |
|---|---|---|---|---|
| 2 min development | 40.8 | 39.4 | 37.5 | 37.3 |
| 48 hour development | 33.8 | 34.3 | 33.4 | 33.6 |
| 15 hour fade | 70.2 | 66.3 | 65.7 | 77.2 |
| Intensity decline | 36.4 | 32.0 | 32.3 | 43.6 |

EXAMPLE 18

This illustrates the production of two hydrated zirconia/hydrated silica/hydrated alumina composites by a process in which the hydrated zirconia and hydrated alumina are first precipitated from solution together and hydrated silica is then precipitated on to the hydrated zirconia/hydrated alumina composite so formed.

The procedure was as described in Example 17 above except that after precipitation of the hydrated zirconia/hydrated alumina composite, S g of a solution of 30% w/w sodium silicate (3.2:1 $SiO_2$:$Na_2O$) were added and the pH was re-adjusted to 7.0 using 20% w/w sulphuric acid. The precipitate was then filtered off and the subsequent procedure was as in Example 14.

The values of Z, S and A, and the proportions of zirconia:silica:alumina in the composite on a dry weight basis, based on the total dry weight of zirconia, silica and alumina were as follows:

| Z (g) | S (g) | A (g) | $ZrO_2$:$SiO_2$:$Al_2O_3$ (%) |
|---|---|---|---|
| 145.44 | 83.33 | 257.35 | 33:33:33 |
| 174.53 | 100.00 | 154.41 | 40:40:20 |

The above procedure was then repeated in a second run, and the results of the calender intensity and fade resistance tests were as follows:

| Test Conditions | Run No. Paper D 1 | 2 | Paper F 1 | 2 |
|---|---|---|---|---|
| 2 min. development | 54.7 | 53.9 | 43.7 | 43.4 |
| 48 hour development | 48.0 | 51.0 | 36.3 | 36.3 |
| 15 hour fade | 80.7 | 80.9 | 57.1 | 57.5 |
| Intensity decline | 32.7 | 29.9 | 20.8 | 21.2 |

No testing was done in this instance with Paper E.

No testing was done in this instance with Paper E.

EXAMPLE 19

This illustrates the production of a hydrated zirconia/hydrated silica/hydrated alumina composite by a process in which hydrated silica is first precipitated, followed by hydrated zirconia, followed by hydrated alumina.

20% w/w sulphuric acid was added to 83.33 g of a 30% w/w solution of sodium silicate (3.2:1 $SiO_2$:$Na_2O$) until the pH was 7.0, by which time hydrated silica had been precipitated. 145.44 g of 30% w/w solution of zirconyl chloride $ZrOCl_2.8H_2O$ were added, and the pH was readjusted to 7.0 by the addition of 10N sodium hydroxide solution, with resultant precipitation of hydrated zirconia. 257.35 g of 40% w/w solution of aluminium sulphate, $Al_2(SO_4)_3.16H_2O$ were added and the pH was re-adjusted to 7.0 with 10N sodium hydroxide solution, with resultant precipitation of hydrated alumina. The resultant composite precipitate was filtered off and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 54.0 | — | 40.4 |
| 48 hour development | 47.8 | 60.2 | 35.8 |
| 15 hour fade | 74.4 | 64.7 | 56.8 |
| Intensity decline | 26.6 | 4.5 | 21.0 |

EXAMPLE 20

This illustrates the production of a hydrated zirconia/hydrated silica/hydrated alumina composite by a process in which hydrated zirconia is first precipitated, followed by hydrated silica, followed by hydrated alumina.

10N sodium hydroxide solution was added to 145.44 g of 30% w/w solution of zirconyl chloride, $ZrOCl_2.8H_2O$ until the pH was 7.0 by which time hydrated zirconia had been precipitated. 83.33 g of a 30% w/w solution of sodium silicate (3.2:1 $SiO_2$:$Na_2O$) were added and the pH was readjusted to 7.0 with 20% w/w sulphuric acid, with resultant precipitation of hydrated silica. 257.35 g of 40% w/w solution of aluminium sulphate, $Al_2(SO_4)_3.16H_2O$ were added and the pH was re-adjusted to 7.0 with 10N sodium hydroxide solution, with resultant precipitation of hydrated alumina. The resultant composite precipitate was filtered off and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 52.8 | — | 40.9 |
| 48 hour development | 46.2 | 59.3 | 33.9 |
| 15 hour fade | 74.6 | 63.7 | 54.9 |
| Intensity decline | 28.4 | 4.4 | 21.0 |

EXAMPLE 21

This illustrates the production of a hydrated zirconia/hydrated silica/hydrated alumina composite by a process in which hydrated zirconia is first precipitated, followed by hydrated alumina, followed by hydrated silica.

10N sodium hydroxide solution was added to 145.44 g of 30% w/w solution of zirconyl chloride $ZrOCl_2.8H_2O$ until the pH was 7.0, by which time hydrated zirconia had been precipitated. 257.35 g of 40% w/w solution of aluminium sulphate, $Al_2(SO_4)_3.16H_2O$ were added and the pH was re-adjusted to 7.0 with 10N sodium hydroxide solution, with resultant precipitation of hydrated alumina. 83.33 g of a 30% w/w solution of sodium silicate (3.2:1 $SiO_2$:$Na_2O$) were then added and the pH was re-adjusted to 7.0 with 20% w/w sulphuric acid, with resultant precipitation of hydrated silica. The composite precipitate was filtered off and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 53.0 | — | 41.4 |
| 48 hour development | 47.2 | 61.5 | 36.4 |
| 15 hour fade | 73.6 | 63.6 | 55.4 |
| Intensity decline | 26.4 | 2.1 | 19.0 |

EXAMPLE 22

This illustrates the production of a hydrated zirconia/hydrated silica/hydrated alumina composite by a process in which hydrated alumina is first precipitated, followed by hydrated zirconia, followed by hydrated silica.

10N sodium hydroxide solution was added to 257.35 g of 40% w/w solution of aluminium sulphate, $Al_2(SO_4)_3.16H_2O$ until the pH was 7.0 by which time hydrated alumina had been precipitated. 145.44 g of 30% w/w solution of zirconyl chloride $ZrOCl_2.8H_2O$ were added, and the pH was re-adjusted to 7.0 by the addition of 10N sodium hydroxide solution, with resultant precipitation of hydrated zirconia. 83.33 g of a 30% w/w solution of sodium silicate (3.2:1 $SiO_2$:$Na_2O$) were then added and the pH was re-adjusted to 7.0 using 20% w/w sulphuric acid, with resultant precipitation of hydrated silica. The composite precipitate was filtered off and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 53.0 | — | 41.3 |
| 48 hour development | 45.5 | 63.9 | 34.7 |
| 15 hour fade | 63.1 | 65.7 | 44.7 |
| Intensity decline | 17.6 | 1.8 | 10.0 |

EXAMPLE 23

This illustrates the production of a hydrated zirconia/hydrated silica/hydrated alumina composite by a process in which hydrated silica is first precipitated, followed by hydrated alumina, followed by hydrated zirconia.

20% w/w sulphuric acid was added to 83.33 g of 30% w/w sodium silicate solution (3.2:1 $SiO_2$:$Na_2O$) until the pH was 7.0, by which time hydrated silica had been precipitated. 257.35 g of 40% w/w solution of aluminium sulphate, $Al_2(SO_4)_3.16H_2O$ were added and the pH was re-adjusted to 7.0 with 10N sodium hydroxide solution, with resultant precipitation of hydrated alumina. 145.44 g of 30% w/w solution of zirconyl chloride $ZrOCl_2.8H_2O$ were added, and the pH was re-adjusted to 7.0 by the addition of 10N sodium hydroxide solution, with resultant precipitation of hydrated zirconia. The composite precipitate was filtered off and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 55.6 | — | 41.7 |
| 48 hour development | 51.2 | 64.1 | 37.6 |
| 15 hour fade | 78.4 | 68.2 | 57.8 |
| Intensity decline | 27.2 | 4.1 | 20.2 |

EXAMPLE 24

This illustrates the production of a hydrated zirconia/hydrated silica/hydrated alumina composite by a process in which hydrated alumina is first precipitated, followed by hydrated silica, followed by hydrated zirconia.

10N sodium hydroxide solution was added to 257.35 g of 40% w/w solution of aluminium sulphate, $Al_2(SO_4)_3.16H_2O$ until the pH was 7.0 by which time hydrated alumina had been precipitated. 83.33 g of 30% w/w sodium silicate solution (3.2:1 $SiO_2$:$Na_2O$) were then added and the pH was re-adjusted to 7.0 using 20% w/w sulphuric acid, with resultant precipitation of hydrated silica. 145.44 g of 30% w/w solution of zirconyl chloride $ZrOCl_2.8H_2O$ were added, and the pH was re-adjusted to 7.0 by the addition of 10N sodium hydroxide solution with resultant precipitation of hydrated zirconia. The composite precipitate was filtered off and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 57.4 | — | 37.5 |
| 48 hour development | 46.2 | 63.3 | 34.0 |
| 15 hour fade | 73.9 | 70.6 | 56.3 |
| Intensity decline | 27.7 | 7.3 | 22.3 |

EXAMPLE 25

This illustrates the preparation of a hydrated zirconia/hydrated alumina composite by a process in which hydrated zirconia and hydrated alumina, both in freshly-precipitated form, are admixed.

10N sodium hydroxide solution was added to 218.16 g of 30% w/w solution of zirconyl chloride, $ZrOCl_2.8H_2O$ until the pH was 7.0, with resultant precipitation of hydrated zirconia.

10N sodium hydroxide solution was also added to 386.03 g of 40% w/w solution of aluminium sulphate, $Al_2(SO_4)_3.16H_2O$ until the pH was 7.0, with resultant precipitation of hydrated alumina.

The precipitates from the above were each filtered off and washed twice with de-ionized water before being redispersed in de-ionized water. The dispersions were each ball-milled until the particle size of the composite was approximately 4 μm (as measured using a Coulter Counter), after which they were combined, and 17.65 g latex binder (Dow 675) were added, so as to give a 15% latex content on a dry weight basis. The procedure from this point on was as in Example 14.

The calender intensity and fade resistance results were as follows:

| Test Conditions | Test Paper | | |
|---|---|---|---|
| | Paper D | Paper E | Paper F |
| 2 min. development | 50.8 | — | 38.5 |
| 48 hour development | 45.4 | 73.9 | 32.6 |
| 15 hour fade | 74.6 | 82.1 | 56.1 |
| Intensity decline | 29.2 | 8.2 | 23.5 |

EXAMPLE 26

This illustrates the preparation of a hydrated zirconia/hydrated silica composite by a process in which hydrated zirconia and hydrated silica, both in freshly-precipitated form, are admixed.

10N sodium hydroxide solution was added to 218.16 g of 30% w/w solution of zirconyl chloride, $ZrOCl_2.8H_2O$ until the pH was 7.0, with resultant precipitation of hydrated zirconia.

20% w/w sulphuric acid was also added to 125.00 g of 30% w/w sodium silicate solution (3.2:1 $SiO_2$:$Na_2O$) until the pH was 7.0, with resultant precipitation of hydrated silica.

The precipitates from the above were each filtered off and washed twice with de-ionized water before being redispersed in de-ionized water. The dispersions were each ball-milled until the particle size of the composite was approximately 4 μm (as measured using a Coulter Counter), after which they were combined, and 17.63 g latex binder (Dow 675) were added, so as to give a 15% latex content on a dry weight basis. The procedure from this point on was as in Example 14.

The calender intensity and fade resistance results were as follows:

| Test Conditions | Test Paper | | |
|---|---|---|---|
| | Paper D | Paper E | Paper F |
| 2 min. development | 56.1 | — | 42.7 |
| 48 hour development | 51.5 | 71.6 | 37.8 |
| 15 hour fade | 94.3 | 69.4 | 72.9 |
| Intensity decline | 42.8 | −2.2 | 35.1 |

EXAMPLE 27

This illustrates the preparation of a hydrated zirconia/hydrated silica/hydrated alumina composite by a process in which hydrated zirconia, hydrated silica and hydrated alumina, all in freshly-precipitated form, are admixed.

10N sodium hydroxide solution was added to 145.44 g of 30% w/w solution of zirconyl chloride, $ZrOCl_2.8H_2O$ until the pH was 7.0, with resultant precipitation of hydrated zirconia.

10N sodium hydroxide solution was also added to 257.35 g of 40% w/w solution of aluminium sulphate, $Al_2(SO_4)_3.16H_2O$ until the pH was 7.0, with resultant precipitation of hydrated alumina. 20% w/w sulphuric acid was also added to 83.33 g of 30% w/w sodium silicate solution (3.2:1 $SiO_2$:$Na_2O$) until the pH was 7.0, with resultant precipitation of hydrated silica.

The precipitates from the above were each filtered off and washed twice with de-ionized water before being redispersed in de-ionized water. The dispersions were each ball-milled until the particle size of the composite was approximately 4 μm (as measured using a Coulter Counter), after which they were combined, and 17.65 g latex binder (Dow 675) were added, so as to give a 15% latex content on a dry weight basis. The procedure from this point on was as in Example 14.

The calender intensity and fade resistance results were as follows:

| Test Conditions | Test Paper | | |
|---|---|---|---|
| | Paper D | Paper E | Paper F |
| 2 min. development | 53.4 | — | 40.8 |
| 48 hours development | 49.2 | 64.8 | 35.4 |
| 15 hours fade | 66.7 | 66.2 | 50.1 |
| Intensity decline | 17.5 | 1.4 | 14.7 |

EXAMPLE 28

This illustrates the production of a hydrated zirconia/hydrated silica/hydrated alumina composite by a process in which hydrated silica and hydrated alumina are precipitated together on to previously-precipitated hydrated zirconia.

10N sodium hydroxide solution was added to 145.44 g of 30% w/w solution of zirconyl chloride, $ZrOCl_2.8H_2O$ until the pH was 7.0, with resultant precipitation of hydrated zirconia. 83.33 g of a 30% w/w solution of sodium silicate (3.2:1 $SiO_2$:$Na_2O$) were added, followed slowly by 257.35 g of 40% w/w solution of aluminium sulphate, $Al_2(SO_4)_3.16H_2O$ and the pH of the resulting mixture was re-adjusted to 7.0, with 10N sodium hydroxide solution, with resultant precipitation of hydrated silica and hydrated alumina on to the hydrated zirconia. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 52.3 | — | 37.9 |
| 48 hour development | 48.0 | 65.0 | 35.2 |
| 15 hour fade | 65.4 | 69.3 | 48.5 |
| Intensity decline | 17.4 | 4.3 | 13.3 |

EXAMPLE 29

This illustrates the production of a hydrated zirconia/hydrated silica/hydrated alumina composite by a process in which hydrated zirconia and hydrated silica are precipitated together on to previously-precipitated hydrated alumina.

10N sodium hydroxide solution was added to 257.35 g of 40% w/w solution of aluminium sulphate, $Al_2(SO_4)_3.16H_2O$ until the pH was 7.0, with resultant precipitation of hydrated alumina 83.33 g of a 30% w/w solution of sodium silicate (3.2:1 $SiO_2$:$Na_2O$) were added, followed slowly by 145.44 g of 30% w/w solution of zirconyl chloride, $ZrOCl_2.8H_2O$ and the pH of the resulting mixture was re-adjusted to 7.0 with 10N sodium hydroxide solution, with resultant precipitation of hydrated zirconia and hydrated silica on to the hydrated alumina. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 51.6 | — | 39.7 |
| 48 hour development | 46.5 | 68.6 | 34.7 |
| 15 hour fade | 72.5 | 74.6 | 53.4 |
| Intensity decline | 26.0 | 6.0 | 18.7 |

EXAMPLE 30

This illustrates the production of a hydrated zirconia/hydrated silica/hydrated alumina composite by a process in which hydrated zirconia and hydrated alumina are precipitated together on to previously-precipitated hydrated silica.

20% w/w sulphuric acid was added to 83.33 g of 30% w/w solution of sodium silicate (3.2:1 $SiO_2$:$Na_2O$) until the pH was 7.0, with resultant precipitation of hydrated silica. 257.35 g of 40% w/w solution of aluminium sulphate, $Al_2(SO_4)_3.16H_2O$ were added followed slowly by 145.44 g of 30% w/w solution of zirconyl chloride, $ZrOCl_2.8H_2O$, and the pH of the resulting mixture was re-adjusted to 7.0 with 10N sodium hydroxide solution, with resultant precipitation of hydrated silica and hydrated alumina on to the hydrated zirconia. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 53.3 | — | 37.8 |
| 48 hour development | 44.8 | 64.5 | 32.6 |
| 15 hour fade | 66.0 | 68.9 | 45.1 |
| Intensity decline | 21.2 | 4.4 | 12.5 |

EXAMPLE 31

This illustrates the production of a hydrated zirconia/hydrated alumina composite by a process in which hydrated alumina is precipitated from sodium aluminate solution on to previously-precipitated hydrated zirconia.

10N sodium hydroxide solution was added to 218.16 g of 30% w/w solution of zirconyl chloride, $ZrOCl_2.8H_2O$ until the pH was 7.0, with resultant precipitation of hydrated zirconia. 99.26 g of 40% w/w sodium aluminate solution were added and the pH of the resulting mixture was re-adjusted to 7.0 with 20% w/w sulphuric acid, with resultant precipitation of hydrated alumina on to the hydrated zirconia. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 50.5 | — | 38.4 |

-continued

| Test Conditions | Test Paper | | |
|---|---|---|---|
| | Paper D | Paper E | Paper F |
| 48 hour development | 46.2 | 79.7 | 34.3 |
| 15 hour fade | 85.8 | 91.0 | 65.1 |
| Intensity decline | 39.6 | 11.3 | 30.8 |

EXAMPLE 32

This illustrates the production of a hydrated zirconia/hydrated silica/hydrated alumina composite by a process in which hydrated silica and hydrated alumina are precipitated together on to previously-precipitated hydrated zirconia, but which differs from Example 28 in that sodium aluminate is used in place of aluminium sulphate.

10N sodium hydroxide solution was added to 145.44 g of 30% w/w solution of zirconyl chloride, $ZrOCl_2.8H_2O$ until the pH was 7.0, with resultant precipitation of hydrated zirconia. 83.33 g of 30% w/w sodium silicate solution (3.2:1 $SiO_2$:$Na_2O$) were added, followed by 66.12 g of 40% w/w sodium aluminate solution, and the pH of the resulting mixture was re-adjusted to 7.0 with 10N sodium hydrated solution, with resultant precipitation of hydrated silica and hydrated alumina on to the hydrated zirconia. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 50.2 | — | 39.0 |
| 48 hour development | 46.3 | 63.8 | 35.0 |
| 15 hour fade | 75.7 | 68.1 | 54.9 |
| Intensity decline | 29.4 | −4.3 | 19.9 |

EXAMPLE 33

This illustrates the production of a hydrated zirconia/hydrated silica/hydrated alumina composite by a process in which hydrated silica and hydrated alumina are precipitated together on to previously-precipitated hydrated zirconia, but which differs from Example 28 in that zirconium sulphate is used in place of zirconyl chloride.

10N sodium hydroxide solution was added to 92.59 g of 30% w/w solution of zirconium sulphate, $Zr(SO_4)_2.H_2O$ until the pH was 7.0, with resultant precipitation of hydrated zirconia. 83.33 g of 30% w/w sodium silicate solution (3.2:1 $SiO_2$:$Na_2O$) were added, followed slowly by 257.35 g of 40% w/w solution of aluminium sulphate, $Al_2(SO_4)_3.16H_2O$ and the pH of the resulting mixture was re-adjusted to 7.0 with 10N sodium hydroxide solution, with resultant precipitation of hydrated silica and hydrated alumina on to the hydrated zirconia. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 52.5 | — | 42.1 |

-continued

| Test Conditions | Test Paper | | |
|---|---|---|---|
| | Paper D | Paper E | Paper F |
| 48 hour development | 45.2 | 64.3 | 33.9 |
| 15 hour fade | 74.9 | 70.4 | 55.1 |
| Intensity decline | 29.7 | 6.1 | 21.2 |

EXAMPLE 34

This illustrates the production of a hydrated zirconia/hydrated silica/hydrated alumina composite by a process in which hydrated silica and hydrated alumina are precipitated together on to previously-precipitated hydrated zirconia, but which differs from Example 28 in that zirconium nitrate is used in place of zirconyl chloride.

10N sodium hydroxide solution was added to 97.11 g of 30% w/w solution of zirconium nitrate (anhydrous) until the pH was 7.0, with resultant precipitation of hydrated zirconia. 83.33 g of 30% w/w sodium silicate solution (3.2:1 $SiO_2$:$Na_2O$) were added, followed slowly by 257.35 g of 40% w/w solution of aluminium sulphate, $Al_2(SO_4)_3.16H_2O$, and the pH of the resulting mixture was re-adjusted to 7.0 with 10N sodium hydroxide solution, with resultant precipitation of hydrated silica and hydrated alumina on to the hydrated zirconia. The composite precipitate was filtered off, and the procedure from this point was as in Example 14.

The calender intensity and fade resistance results were as follows:

| Test Conditions | Test Paper | | |
|---|---|---|---|
| | Paper D | Paper E | Paper F |
| 2 min. development | 54.3 | — | 46.6 |
| 48 hour development | 46.6 | 64.7 | 35.9 |
| 15 hour fade | 72.4 | 69.9 | 55.7 |
| Intensity decline | 25.8 | 5.2 | 19.2 |

EXAMPLE 35

This demonstrates the suitability of a typical example of a colour former according to the invention for use in heat-sensitive record material.

20 g of a washed and dried hydrated zirconia/hydrated alumina/hydrated zirconia composite prepared by the method of Example 1 (Run No. 1) were mixed with 48 g of stearamide wax and ground in a pestle and mortar. 45 g of de-ionized water and 60 g of 10% w/w poly(vinyl alcohol) solution (that supplied as "Gohsenol GL05" by Nippon Gohsei of Japan) were added and the mixture was ball-milled overnight. A further 95 g of 10% w/w poly(vinyl alcohol) solution were then added, together with 32 g de-ionized water.

In a separate procedure, 22 g of a black colour former (2'-anilino-6'diethylamino-3'-methylfluoran), were mixed with 42 g de-ionized water and 100 g of 10% w/w poly(vinyl alcohol) solution, and the mixture was ball-milled overnight.

The suspensions resulting from the above procedures were then mixed and coated on to paper by means of a laboratory Meyer bar coater at a nominal coat weight of 8 $gm^{-2}$. The paper was then dried.

On subjecting the coated surface to heat, a black colouration was obtained.

I claim:

1. Record material carrying a colour developer composition which comprises a particulate composite having as components hydrated zirconia and at least one of hydrated silica and hydrated alumina.

2. Record material as claimed in claim 1, characterized in that at least one of the components of the composite is present in a greater proportion in a surface region of the composite than elsewhere.

3. Record material as claimed in claim 2, characterized in that the composite is modified by the presence of a compound or ions of one or more multivalent metals.

4. Record material as claimed in claim 1 characterized in that the composite is modified by the presence of a compound or ions of one or more multivalent metals.

* * * * *